US010954049B2

(12) United States Patent
Glass et al.

(10) Patent No.: US 10,954,049 B2
(45) Date of Patent: Mar. 23, 2021

(54) VISCOUS LIQUID VESSEL FOR GIFTING

(71) Applicant: e2interactive, Inc., Atlanta, GA (US)

(72) Inventors: Nicole E. Glass, Kansas City, MO (US); Brett R. Glass, Kansas City, MO (US); Dominique Michelle Pierron O'Hara, Kansas City, MO (US)

( * ) Notice: Subject to any disclaimer, the term of this patent is extended or adjusted under 35 U.S.C. 154(b) by 0 days.

(21) Appl. No.: 16/217,181

(22) Filed: Dec. 12, 2018

(65) Prior Publication Data

US 2019/0177070 A1 Jun. 13, 2019

Related U.S. Application Data

(60) Provisional application No. 62/597,588, filed on Dec. 12, 2017.

(51) Int. Cl.

| | |
|---|---|
| ***B65D 81/24*** | (2006.01) |
| ***B65D 85/48*** | (2006.01) |
| ***B65D 79/00*** | (2006.01) |
| ***B65D 23/00*** | (2006.01) |
| ***B65D 85/00*** | (2006.01) |
| ***B65D 25/10*** | (2006.01) |
| ***B65D 81/22*** | (2006.01) |

(52) U.S. Cl.

CPC ..... *B65D 79/00* (2013.01); *B65D 23/00* (2013.01); *B65D 25/10* (2013.01); *B65D 81/22* (2013.01); *B65D 85/70* (2013.01)

(58) Field of Classification Search

CPC ..... B65D 23/00; B65D 25/10; B65D 79/00; B65D 81/22; B65D 85/70

USPC ..... 206/205, 449, 575, 459.5; 446/70, 85, 446/385

See application file for complete search history.

(56) References Cited

U.S. PATENT DOCUMENTS

| | | | |
|---|---|---|---|
| 794,417 | A | 7/1905 | Maniachi |
| 3,288,350 | A | 11/1966 | Kushner |
| 4,068,213 | A | 1/1978 | Nakamura et al. |
| 4,482,802 | A | 11/1984 | Aizawa et al. |
| 4,734,858 | A | 3/1988 | Schlafly |

(Continued)

FOREIGN PATENT DOCUMENTS

| | | | |
|---|---|---|---|
| EP | 0950968 | A4 | 5/2004 |
| EP | 1519332 | A1 | 3/2005 |

(Continued)

OTHER PUBLICATIONS

Eazel, William, "Paypal intros SMS Payments," http://www.v3co.uk/articles/print/2152694, vnunet.com, Mar. 24, 2006, 1 page.

(Continued)

*Primary Examiner* — Luan K Bui

(74) *Attorney, Agent, or Firm* — Landmark Intellectual Property Law, PLLC; Gregory Murphy

(57) ABSTRACT

A viscous liquid vessel system for presenting a gift is described herein. In some embodiments, the viscous liquid vessel system comprises a vessel containing a viscous liquid in which a gift is disposed. The vessel comprises a lid for enclosing the viscous liquid and the gift. The viscous liquid vessel system may be presented to a gift recipient and the gift recipient may remove the gift from the vessel and the viscous liquid creating a heightened emotion upon receipt and extraction of the gift.

19 Claims, 6 Drawing Sheets

(56) References Cited

U.S. PATENT DOCUMENTS 4,747,049 A 5/1988 Richardson et al.
4,755,940 A 7/1988 Brachtl et al.
4,765,478 A * 8/1988 Bringloe ..... A61F 15/001 206/440
4,767,917 A 8/1988 Ushikubo
4,795,892 A 1/1989 Gilmore et al.
4,877,947 A 10/1989 Mori
4,900,904 A 2/1990 Wright et al.
4,908,521 A 3/1990 Boggan et al.
4,943,707 A 7/1990 Boggan
5,091,634 A 2/1992 Finch et al.
5,117,355 A 5/1992 McCarthy
5,202,826 A 4/1993 McCarthy
5,255,182 A 10/1993 Adams
5,256,863 A 10/1993 Ferguson et al.
5,311,424 A 5/1994 Mukherjee et al.
5,367,148 A 11/1994 Storch et al.
5,375,240 A 12/1994 Grundy
5,383,113 A 1/1995 Kight et al.
5,384,449 A 1/1995 Peirce
5,465,288 A 11/1995 Falvey et al.
5,477,038 A 12/1995 Levine et al.
5,500,513 A 3/1996 Langhans et al.
5,502,765 A 3/1996 Ishiguro et al.
5,511,114 A 4/1996 Stimson et al.
5,553,643 A * 9/1996 Goldfarb ..... A63H 33/22 118/52
5,577,109 A 11/1996 Stimson et al.
5,581,064 A 12/1996 Riley et al.
5,590,038 A 12/1996 Pitroda
5,602,377 A 2/1997 Beller et al.
5,619,559 A 4/1997 Kennedy
5,621,201 A 4/1997 Langhans et al.
5,621,787 A 4/1997 McKoy et al.
5,644,721 A 7/1997 Chung et al.
5,657,389 A 8/1997 Houvener
5,671,279 A 9/1997 Elgamal
5,679,938 A 10/1997 Templeton et al.
5,679,940 A 10/1997 Templeton et al.
5,696,909 A 12/1997 Wallner
5,699,528 A 12/1997 Hogan
5,705,798 A 1/1998 Tarbox
5,708,780 A 1/1998 Levergood et al.
5,721,768 A 2/1998 Stimson et al.
5,721,781 A 2/1998 Deo et al.
5,729,693 A 3/1998 Holda-Fleck
5,732,136 A 3/1998 Murphree et al.
5,734,719 A 3/1998 Tsevdos et al.
5,740,915 A 4/1998 Williams
5,754,655 A 5/1998 Hughes et al.
5,760,381 A 6/1998 Stich et al.
5,777,305 A 7/1998 Smith et al.
5,799,285 A 8/1998 Klingman
5,806,045 A 9/1998 Biorge et al.
5,828,740 A 10/1998 Khuc et al.
5,844,972 A 12/1998 Jagadish et al.
5,850,217 A 12/1998 Cole
5,857,175 A 1/1999 Day et al.
5,873,072 A 2/1999 Kight et al.
5,878,401 A 3/1999 Joseph
5,884,271 A 3/1999 Pitroda
5,889,270 A 3/1999 Haagen et al.
5,889,863 A 3/1999 Weber
5,897,625 A 4/1999 Gustin et al.
5,903,633 A 5/1999 Lorsch
5,903,830 A 5/1999 Joao et al.
5,903,874 A 5/1999 Leonard et al.
5,907,142 A 5/1999 Kelsey
5,909,492 A 6/1999 Payne et al.
5,913,210 A 6/1999 Call
5,918,213 A 6/1999 Bernard et al.
5,930,363 A 7/1999 Stanford et al.
5,945,653 A 8/1999 Walker et al.
5,950,173 A 9/1999 Perkowski
5,953,710 A 9/1999 Fleming
5,954,561 A * 9/1999 Cannone ..... A63H 33/3055 434/127
5,956,695 A 9/1999 Carrithers et al.
5,956,700 A 9/1999 Landry
5,968,110 A 10/1999 Westrope et al.
5,984,508 A 11/1999 Hurley
5,988,509 A 11/1999 Taskett
5,991,413 A 11/1999 Arditti et al.
5,991,748 A 11/1999 Taskett
5,991,749 A 11/1999 Morrill, Jr.
5,999,624 A 12/1999 Hopkins
6,000,608 A 12/1999 Dorf
6,012,049 A 1/2000 Kawan
6,018,570 A 1/2000 Matison
6,025,780 A 2/2000 Bowers et al.
6,029,139 A 2/2000 Cunningham et al.
6,029,141 A 2/2000 Bezos et al.
6,029,151 A 2/2000 Nikander
6,032,135 A 2/2000 Molano et al.
6,032,859 A 3/2000 Muehlberger et al.
6,039,244 A 3/2000 Finsterwald
6,049,778 A 4/2000 Walker et al.
6,055,511 A 4/2000 Luebbering et al.
6,055,567 A 4/2000 Ganesan et al.
6,058,300 A 5/2000 Hanson
6,058,382 A 5/2000 Kasai et al.
6,062,472 A 5/2000 Cheung
6,070,150 A 5/2000 Remington et al.
6,085,167 A 7/2000 Iguchi
6,085,242 A 7/2000 Chandra
6,088,682 A 7/2000 Burke
6,092,053 A 7/2000 Boesch et al.
6,098,053 A 8/2000 Slater
6,105,008 A 8/2000 Davis et al.
6,119,164 A 9/2000 Basche
6,125,352 A 9/2000 Franklin et al.
6,129,276 A 10/2000 Jelen et al.
6,134,533 A 10/2000 Shell
6,138,106 A 10/2000 Walker et al.
6,138,911 A 10/2000 Fredregill et al.
6,142,369 A 11/2000 Jonstromer
6,148,249 A 11/2000 Newman
6,167,387 A 12/2000 Lee-Wai-Yin
6,169,890 B1 1/2001 Vatanen
6,173,272 B1 1/2001 Thomas et al.
6,175,823 B1 1/2001 Dusen
6,185,545 B1 2/2001 Resnick et al.
6,188,752 B1 2/2001 Lesley
6,219,652 B1 4/2001 Carter et al.
6,222,914 B1 4/2001 McMullin
6,226,364 B1 5/2001 O'Neil
6,240,397 B1 5/2001 Sachs
6,256,690 B1 7/2001 Carper
6,282,566 B1 8/2001 Lee, Jr. et al.
6,285,749 B1 9/2001 Manto
6,289,322 B1 9/2001 Kitchen et al.
6,295,522 B1 9/2001 Boesch
6,304,860 B1 10/2001 Martin, Jr. et al.
6,308,887 B1 10/2001 Korman et al.
6,311,165 B1 10/2001 Coutts et al.
6,311,170 B1 10/2001 Embrey
6,314,171 B1 11/2001 Dowens
6,315,195 B1 11/2001 Ramachandran
6,317,028 B1 11/2001 Valiulis
6,324,525 B1 11/2001 Kramer et al.
6,327,577 B1 12/2001 Garrison et al.
6,330,544 B1 12/2001 Walker et al.
6,332,135 B1 12/2001 Conklin et al.
6,333,976 B2 12/2001 Lesley
6,334,116 B1 12/2001 Ganesan et al.
6,360,254 B1 3/2002 Linden et al.
6,363,362 B1 3/2002 Burfield et al.
6,363,364 B1 3/2002 Nel
6,366,893 B2 4/2002 Hannula et al.
6,375,073 B1 4/2002 Aebi et al.
6,422,462 B1 7/2002 Cohen
6,424,706 B1 7/2002 Katz et al.
6,434,238 B1 8/2002 Chaum et al.
6,442,532 B1 8/2002 Kawan

(56) References Cited

U.S. PATENT DOCUMENTS 6,467,684 B2 10/2002 Fite et al.
6,473,500 B1 10/2002 Risafi et al.
6,473,739 B1 10/2002 Showghi et al.
6,494,367 B1 12/2002 Zacharias
6,502,745 B1 1/2003 Stimson et al.
6,507,823 B1 1/2003 Nel
6,529,956 B1 3/2003 Smith et al.
6,536,659 B1 3/2003 Hauser et al.
6,542,933 B1 4/2003 Durst, Jr. et al.
6,550,672 B1 4/2003 Tracy et al.
6,575,361 B1 6/2003 Graves et al.
6,581,827 B2 6/2003 Welton
6,591,098 B1 7/2003 Shieh et al.
6,594,640 B1 7/2003 Postrel
6,594,644 B1 7/2003 Dusen
6,609,113 B1 8/2003 O'Leary et al.
6,615,189 B1 9/2003 Phillips et al.
6,615,190 B1 9/2003 Slater
6,622,015 B1 9/2003 Himmel et al.
6,636,833 B1 10/2003 Flitcroft et al.
6,648,222 B2 11/2003 McDonald et al.
6,651,885 B1 11/2003 Arias
6,659,259 B2 12/2003 Knox et al.
6,678,664 B1 1/2004 Ganesan
6,684,269 B2 1/2004 Wagner
6,705,520 B1 3/2004 Pitroda et al.
6,745,022 B2 6/2004 Knox
6,769,607 B1 8/2004 Pitroda et al.
6,805,289 B2 10/2004 Noriega et al.
6,807,410 B1 10/2004 Pailles et al.
6,819,219 B1 11/2004 Bolle et al.
6,827,260 B2 12/2004 Stoutenburg et al.
6,829,596 B1 12/2004 Frazee
6,836,765 B1 12/2004 Sussman
6,836,962 B2 1/2005 Khandros et al.
6,839,692 B2 1/2005 Carroll et al.
6,839,744 B1 1/2005 Kloba et al.
6,848,613 B2 2/2005 Nielsen et al.
6,856,974 B1 2/2005 Ganesan et al.
6,868,391 B1 3/2005 Hultgren
6,882,984 B1 4/2005 Boyle et al.
6,915,277 B1 7/2005 Manchester et al.
6,918,537 B2 7/2005 Graves et al.
6,925,439 B1 8/2005 Pitroda
6,932,268 B1 8/2005 McCoy et al.
6,934,529 B2 8/2005 Bagoren et al.
6,934,689 B1 8/2005 Ritter et al.
6,941,270 B1 9/2005 Hannula
6,948,063 B1 9/2005 Ganesan et al.
6,961,412 B2 11/2005 Ruckart et al.
6,965,866 B2 11/2005 Klein
6,975,937 B1 12/2005 Kantarjiev et al.
6,988,657 B1 1/2006 Singer et al.
6,993,510 B2 1/2006 Guy et al.
7,014,107 B2 3/2006 Singer et al.
7,016,863 B1 3/2006 Kamakura et al.
7,024,174 B2 4/2006 Nagy et al.
7,024,396 B2 4/2006 Woodward
7,054,842 B2 5/2006 James
7,069,248 B2 6/2006 Huber
7,072,854 B2 7/2006 Loeser
7,072,864 B2 7/2006 Brake, Jr. et al.
7,083,084 B2 8/2006 Graves et al.
7,085,931 B1 8/2006 Smith et al.
7,086,584 B2 8/2006 Stoutenburg et al.
7,093,761 B2 8/2006 Smith et al.
7,117,227 B2 10/2006 Call
7,128,274 B2 10/2006 Kelley et al.
7,130,817 B2 10/2006 Karas et al.
7,131,582 B2 11/2006 Welton
7,143,055 B1 11/2006 Perkowski
7,162,440 B2 1/2007 Koons
7,165,052 B2 1/2007 Diveley et al.
7,182,252 B1 2/2007 Cooper et al.
7,194,438 B2 3/2007 Sovio et al.
7,209,889 B1 4/2007 Whitfield
7,209,890 B1 4/2007 Peon et al.
7,216,092 B1 5/2007 Weber et al.
7,222,101 B2 5/2007 Bishop et al.
7,229,006 B2 6/2007 Babbi et al.
7,229,014 B1 6/2007 Snyder
7,243,839 B2 7/2007 Beck et al.
7,249,054 B2 7/2007 Keil
7,249,097 B2 7/2007 Hutchison et al.
7,269,256 B2 9/2007 Rosen
7,292,998 B2 11/2007 Graves et al.
7,316,350 B2 1/2008 Algiene
7,328,190 B2 2/2008 Smith et al.
7,333,955 B2 2/2008 Graves et al.
7,356,327 B2 4/2008 Cai et al.
7,363,265 B2 4/2008 Horgan
7,370,012 B2 5/2008 Karns et al.
7,371,144 B1 * 5/2008 Begien ..... A63H 33/32 206/1.7
7,376,431 B2 5/2008 Niedermeyer
7,383,226 B2 6/2008 Kight et al.
7,398,248 B2 7/2008 Phillips et al.
7,400,883 B2 7/2008 Rivers et al.
7,415,617 B2 8/2008 Ginter et al.
7,437,328 B2 10/2008 Graves et al.
7,494,417 B2 2/2009 Walker et al.
7,519,543 B2 4/2009 Ota et al.
7,536,349 B1 5/2009 Mik et al.
7,566,000 B2 7/2009 Agostino et al.
7,590,557 B2 9/2009 Harrison et al.
7,631,803 B2 12/2009 Peyret et al.
7,650,308 B2 1/2010 Nguyen et al.
7,702,542 B2 4/2010 Aslanian, Jr.
7,711,598 B2 5/2010 Perkowski
7,725,326 B1 5/2010 Tracy et al.
7,735,724 B2 6/2010 Fujita et al.
7,757,944 B2 7/2010 Cline et al.
7,774,209 B2 8/2010 James et al.
7,840,437 B2 11/2010 Lewis
7,848,948 B2 12/2010 Perkowski et al.
7,866,548 B2 1/2011 Reed et al.
7,904,333 B1 3/2011 Perkowski
7,905,399 B2 3/2011 Barnes et al.
7,917,386 B2 3/2011 Christensen
7,940,333 B2 5/2011 Suzuki
7,941,373 B1 5/2011 Chang et al.
7,959,076 B1 6/2011 Hopkins, III
8,046,268 B2 10/2011 Hunt
8,060,413 B2 11/2011 Castell et al.
8,103,520 B2 1/2012 Mueller et al.
8,109,436 B1 2/2012 Hopkins, III
8,195,568 B2 6/2012 Singhal
8,332,323 B2 12/2012 Stals et al.
8,355,982 B2 1/2013 Hazel et al.
8,396,758 B2 3/2013 Paradise et al.
8,509,814 B1 8/2013 Parker
8,577,735 B2 11/2013 Wilen et al.
8,636,203 B1 1/2014 Patterson et al.
8,662,387 B1 3/2014 Geller et al.
8,751,298 B1 6/2014 Giordano et al.
8,768,834 B2 7/2014 Zacarias et al.
9,098,190 B2 8/2015 Zhou et al.
9,483,786 B2 11/2016 Glass et al.
9,672,687 B2 6/2017 Cage et al.
2001/0001321 A1 5/2001 Resnick et al.
2001/0001856 A1 5/2001 Gould et al.
2001/0005840 A1 6/2001 Verkama
2001/0007983 A1 7/2001 Lee
2001/0011248 A1 8/2001 Himmel et al.
2001/0032878 A1 10/2001 Tsiounis et al.
2001/0034707 A1 10/2001 Sakaguchi
2001/0037264 A1 11/2001 Husemann et al.
2001/0042784 A1 11/2001 Fite et al.
2001/0044776 A1 11/2001 Kight et al.
2001/0056410 A1 12/2001 Ishigaki
2002/0002535 A1 1/2002 Kitchen et al.
2002/0010627 A1 1/2002 Lerat
2002/0010677 A1 1/2002 Kitchen et al.
2002/0013768 A1 1/2002 Ganesan

(56) References Cited

U.S. PATENT DOCUMENTS

2002/0019809 A1 2/2002 Kitchen et al.
2002/0022472 A1 2/2002 Watler et al.
2002/0046165 A1 4/2002 Kitchen et al.
2002/0046166 A1 4/2002 Kitchen et al.
2002/0046167 A1 4/2002 Kitchen et al.
2002/0046168 A1 4/2002 Kitchen et al.
2002/0049672 A1 4/2002 Kitchen et al.
2002/0052840 A1 5/2002 Kitchen et al.
2002/0052841 A1 5/2002 Guthrie et al.
2002/0060243 A1 5/2002 Janiak et al.
2002/0062249 A1 5/2002 Iannacci
2002/0062282 A1 5/2002 Kight et al.
2002/0065713 A1 5/2002 Awada et al.
2002/0065773 A1 5/2002 Kight et al.
2002/0065774 A1 5/2002 Young et al.
2002/0077076 A1 6/2002 Suryanarayana et al.
2002/0077993 A1 6/2002 Immonen et al.
2002/0088855 A1 7/2002 Hodes
2002/0091573 A1 7/2002 Hodes
2002/0101966 A1 8/2002 Nelson
2002/0107791 A1 8/2002 Nobrega et al.
2002/0111906 A1 8/2002 Garrison et al.
2002/0115424 A1 8/2002 Bagoren et al.
2002/0116329 A1 8/2002 Serbetcioglu et al.
2002/0119767 A1 8/2002 Fieldhouse et al.
2002/0120571 A1 8/2002 Maung et al.
2002/0128968 A1 9/2002 Kitchen et al.
2002/0138450 A1 9/2002 Kremer
2002/0138573 A1 9/2002 Saguy
2002/0152123 A1 10/2002 Giordano et al.
2002/0152160 A1 10/2002 Allen-Rouman et al.
2002/0152179 A1 10/2002 Racov
2002/0153414 A1 10/2002 Stoutenburg et al.
2002/0161631 A1 10/2002 Banerjee et al.
2002/0169713 A1 11/2002 Chang et al.
2002/0178062 A1 11/2002 Wright et al.
2002/0190123 A1 12/2002 Anvekar et al.
2002/0198722 A1 12/2002 Yuschik
2003/0001005 A1 1/2003 Risafi et al.
2003/0004802 A1 1/2003 Callegari
2003/0004891 A1 1/2003 Rensburg et al.
2003/0004894 A1 1/2003 Rowney
2003/0009382 A1 1/2003 D'Arbeloff et al.
2003/0023552 A1 1/2003 Kight
2003/0028481 A1 2/2003 Flitcroft et al.
2003/0033246 A1 2/2003 Slater
2003/0055735 A1 3/2003 Cameron et al.
2003/0055782 A1 3/2003 Slater
2003/0070080 A1 4/2003 Rosen
2003/0074328 A1 4/2003 Schiff et al.
2003/0093366 A1 5/2003 Halper
2003/0105672 A1 6/2003 Epstein et al.
2003/0105688 A1 6/2003 Brown
2003/0115126 A1 6/2003 Pitroda
2003/0121967 A1 7/2003 Goldberg et al.
2003/0126079 A1 7/2003 Roberson et al.
2003/0141358 A1 7/2003 Hudson et al.
2003/0162565 A1 8/2003 Al-Khaja
2003/0163787 A1 8/2003 Hay et al.
2003/0172039 A1 9/2003 Guy et al.
2003/0191711 A1 10/2003 Jamison et al.
2003/0197059 A1 10/2003 Tidball et al.
2003/0200179 A1 10/2003 Kwan
2003/0200184 A1 10/2003 Dominguez et al.
2003/0212601 A1 11/2003 Silva et al.
2003/0218062 A1 11/2003 Noriega et al.
2003/0218066 A1 11/2003 Fernandes et al.
2003/0220884 A1 11/2003 Choi et al.
2003/0226042 A1 12/2003 Fukushima
2003/0229590 A1 12/2003 Byrne et al.
2003/0233317 A1 12/2003 Judd
2003/0233318 A1 12/2003 King et al.
2003/0234819 A1 12/2003 Daly et al.
2003/0236704 A1 12/2003 Antonucci
2004/0009760 A1 1/2004 Laybourn et al.
2004/0010462 A1 1/2004 Moon et al.
2004/0019564 A1 1/2004 Goldthwaite et al.
2004/0019568 A1 1/2004 Moenickheim et al.
2004/0029569 A1 2/2004 Khan et al.
2004/0046035 A1 3/2004 Davila et al.
2004/0049456 A1 3/2004 Dreyer
2004/0049458 A1 3/2004 Kunugi et al.
2004/0054587 A1 3/2004 Dev et al.
2004/0059671 A1 3/2004 Nozaki et al.
2004/0064409 A1 4/2004 Kight et al.
2004/0068446 A1 4/2004 Do et al.
2004/0068448 A1 4/2004 Kim
2004/0078327 A1 4/2004 Frazier et al.
2004/0078332 A1 4/2004 Ferguson et al.
2004/0083170 A1 4/2004 Bam et al.
2004/0083171 A1 4/2004 Kight et al.
2004/0093305 A1 5/2004 Kight et al.
2004/0094624 A1 5/2004 Fernandes et al.
2004/0107170 A1 6/2004 Labrou et al.
2004/0114766 A1 6/2004 Hileman et al.
2004/0117302 A1 6/2004 Weichert et al.
2004/0118914 A1 6/2004 Smith et al.
2004/0128197 A1 7/2004 Bam et al.
2004/0139005 A1 7/2004 Ganesan
2004/0159700 A1 8/2004 Khan et al.
2004/0162058 A1 8/2004 Mottes
2004/0167853 A1 8/2004 Sharma
2004/0181463 A1 9/2004 Goldthwaite et al.
2004/0185881 A1 9/2004 Lee et al.
2004/0199431 A1 10/2004 Ganesan et al.
2004/0199474 A1 10/2004 Ritter
2004/0205023 A1 10/2004 Hafer et al.
2004/0205138 A1 10/2004 Friedman et al.
2004/0210449 A1 10/2004 Breck et al.
2004/0215560 A1 10/2004 Amalraj et al.
2004/0215564 A1 10/2004 Lawlor et al.
2004/0215573 A1 10/2004 Teutenberg et al.
2004/0224660 A1 11/2004 Anderson
2004/0225560 A1 11/2004 Lewis et al.
2004/0230489 A1 11/2004 Goldthwaite et al.
2004/0232225 A1 11/2004 Bishop et al.
2004/0242208 A1 12/2004 Teicher
2004/0243490 A1 12/2004 Murto et al.
2004/0249710 A1 12/2004 Smith et al.
2004/0249766 A1 12/2004 Ganesan et al.
2004/0267663 A1 12/2004 Karns et al.
2004/0267664 A1 12/2004 Nam et al.
2004/0267665 A1 12/2004 Nam et al.
2005/0001027 A1 1/2005 Bahar
2005/0015388 A1 1/2005 Dasgupta et al.
2005/0021457 A1 1/2005 Johnson et al.
2005/0027624 A1 2/2005 Cai
2005/0027655 A1 2/2005 Sharma
2005/0033645 A1 2/2005 DuPhily
2005/0051619 A1 3/2005 Graves et al.
2005/0060261 A1 3/2005 Remington et al.
2005/0061872 A1 3/2005 Paschini et al.
2005/0065876 A1 3/2005 Kumar
2005/0071179 A1 3/2005 Peters et al.
2005/0071269 A1 3/2005 Peters
2005/0075958 A1 4/2005 Gonzalez
2005/0075975 A1 4/2005 Rosner et al.
2005/0079863 A1 4/2005 Macaluso
2005/0080634 A1 4/2005 Kanniainen et al.
2005/0080727 A1 4/2005 Postrel
2005/0086164 A1 4/2005 Kim et al.
2005/0086168 A1 4/2005 Alvarez et al.
2005/0096981 A1 5/2005 Shimada
2005/0097038 A1 5/2005 Yu et al.
2005/0103839 A1 5/2005 Hewel
2005/0107068 A1 5/2005 Smith et al.
2005/0109835 A1 5/2005 Jacoby et al.
2005/0116028 A1 6/2005 Cohen et al.
2005/0125343 A1 6/2005 Mendelovich
2005/0125348 A1 6/2005 Fulton et al.
2005/0127169 A1 6/2005 Foss
2005/0137978 A1 6/2005 Ganesan et al.
2005/0143051 A1 6/2005 Park
2005/0154644 A1 7/2005 Deakin et al.

(56) References Cited

U.S. PATENT DOCUMENTS

2005/0174975 A1 8/2005 Mgrdechian et al.
2005/0177437 A1 8/2005 Ferrier
2005/0177517 A1 8/2005 Leung et al.
2005/0182714 A1 8/2005 Nel
2005/0182720 A1 8/2005 Willard et al.
2005/0184145 A1 8/2005 Law et al.
2005/0187873 A1 8/2005 Labrou et al.
2005/0199709 A1 9/2005 Linlor
2005/0203835 A1 9/2005 Nhaissi et al.
2005/0203844 A1 9/2005 Ferguson et al.
2005/0209965 A1 9/2005 Ganesan
2005/0222925 A1 10/2005 Jamieson
2005/0222961 A1 10/2005 Staib et al.
2005/0228717 A1 10/2005 Gusler et al.
2005/0247777 A1 11/2005 Pitroda
2005/0259589 A1 11/2005 Rozmovits et al.
2005/0261968 A1 11/2005 Randall et al.
2005/0262017 A1 11/2005 Kawase et al.
2005/0269401 A1 12/2005 Spitzer et al.
2005/0269402 A1 12/2005 Spitzer et al.
2005/0274793 A1 12/2005 Cantini et al.
2006/0000900 A1 1/2006 Fernandes et al.
2006/0004631 A1 1/2006 Roberts et al.
2006/0004656 A1 1/2006 Lee
2006/0006226 A1 1/2006 Fitzgerald et al.
2006/0023856 A1 2/2006 Welton
2006/0026070 A1 2/2006 Sun
2006/0037835 A1 2/2006 Doran et al.
2006/0041470 A1 2/2006 Filho et al.
2006/0053056 A1 3/2006 Alspach-Goss et al.
2006/0058011 A1 3/2006 Vanska et al.
2006/0074767 A1 4/2006 Fortney et al.
2006/0080232 A1 4/2006 Epps
2006/0085310 A1 4/2006 Mylet et al.
2006/0089160 A1 4/2006 Othmer
2006/0089893 A1 4/2006 Joseph et al.
2006/0113376 A1 6/2006 Reed et al.
2006/0116892 A1 6/2006 Grimes et al.
2006/0136334 A1 6/2006 Atkinson et al.
2006/0136901 A1 6/2006 Nichols
2006/0161490 A1 7/2006 Chakiris et al.
2006/0163343 A1 7/2006 Changryeol
2006/0167744 A1 7/2006 Yoo
2006/0206436 A1 9/2006 James et al.
2006/0207856 A1 9/2006 Dean et al.
2006/0235754 A1 10/2006 Walker et al.
2006/0253320 A1 11/2006 Heywood
2006/0255125 A1 11/2006 Jennings et al.
2007/0017976 A1 1/2007 Peyret et al.
2007/0021969 A1 1/2007 Homeier-Beals
2007/0030824 A1 2/2007 Ribaudo et al.
2007/0038577 A1 2/2007 Werner et al.
2007/0043682 A1 2/2007 Drapkin et al.
2007/0055785 A1 3/2007 Stevens
2007/0063024 A1 3/2007 Guillot
2007/0100761 A1 5/2007 Dillon
2007/0108269 A1 5/2007 Benco et al.
2007/0114274 A1 5/2007 Gibbs et al.
2007/0118478 A1 5/2007 Graves et al.
2007/0125838 A1 6/2007 Law et al.
2007/0130085 A1 6/2007 Zhu
2007/0156436 A1 7/2007 Fisher et al.
2007/0162337 A1 7/2007 Hawkins et al.
2007/0175984 A1 8/2007 Khandaker et al.
2007/0192182 A1 8/2007 Monaco et al.
2007/0198347 A1 8/2007 Muldoon
2007/0208618 A1 9/2007 Paintin et al.
2007/0233615 A1 10/2007 Tumminaro
2007/0257767 A1 11/2007 Beeson
2007/0262140 A1 11/2007 Long
2007/0265872 A1 11/2007 Robinson et al.
2007/0284434 A1 12/2007 Fletcher
2008/0006685 A1 1/2008 Rackley, III et al.
2008/0010190 A1 1/2008 Rackley, III et al.
2008/0010191 A1 1/2008 Rackley, III et al.
2008/0010192 A1 1/2008 Rackley, III et al.
2008/0010193 A1 1/2008 Rackley, III et al.
2008/0010196 A1 1/2008 Rackley, III et al.
2008/0010204 A1 1/2008 Rackley, III et al.
2008/0010215 A1 1/2008 Rackley, III et al.
2008/0028395 A1 1/2008 Motta et al.
2008/0033817 A1 2/2008 Billmaier et al.
2008/0040265 A1 2/2008 Rackley, III et al.
2008/0041938 A1 2/2008 Wise
2008/0046366 A1 2/2008 Bemmel et al.
2008/0052164 A1 2/2008 Abifaker
2008/0052169 A1 2/2008 O'Shea et al.
2008/0059318 A1 3/2008 Packes et al.
2008/0070690 A1 3/2008 Luchene et al.
2008/0071620 A1 3/2008 Lowe
2008/0078831 A1 4/2008 Johnson et al.
2008/0091545 A1 4/2008 Jennings et al.
2008/0097844 A1 4/2008 Hsu et al.
2008/0097851 A1 4/2008 Bemmel et al.
2008/0103972 A1 5/2008 Lanc
2008/0114699 A1 5/2008 Yuan et al.
2008/0126145 A1 5/2008 Rackley, III et al.
2008/0133351 A1 6/2008 White et al.
2008/0172306 A1 7/2008 Schorr et al.
2008/0172331 A1 7/2008 Graves et al.
2008/0179395 A1 7/2008 Dixon et al.
2008/0228597 A1 9/2008 Sondles
2008/0235095 A1 9/2008 Oles et al.
2008/0255942 A1 10/2008 Craft
2008/0273630 A1 11/2008 Mege et al.
2008/0290987 A1 11/2008 Li
2008/0319868 A1 12/2008 Briscoe et al.
2009/0001159 A1 1/2009 James et al.
2009/0006116 A1 1/2009 Baker et al.
2009/0030789 A1 1/2009 Mashinsky
2009/0037326 A1 2/2009 Chitti et al.
2009/0055296 A1 2/2009 Nelsen
2009/0076896 A1 3/2009 DeWitt et al.
2009/0106115 A1 4/2009 James et al.
2009/0111378 A1 4/2009 Sheynman et al.
2009/0112709 A1 4/2009 Barhydt et al.
2009/0144161 A1 6/2009 Fisher
2009/0157554 A1 6/2009 Hobson et al.
2009/0164329 A1 6/2009 Bishop et al.
2009/0171739 A1 7/2009 De et al.
2009/0171804 A1 7/2009 Lee et al.
2009/0173782 A1 7/2009 Muscato
2009/0173784 A1 7/2009 Yang
2009/0187491 A1 7/2009 Bull et al.
2009/0192904 A1 7/2009 Patterson et al.
2009/0192928 A1 7/2009 Abifaker
2009/0247131 A1 10/2009 Champion et al.
2009/0254453 A1 10/2009 Sanguinetti et al.
2009/0281915 A1 11/2009 Deakin et al.
2009/0281941 A1 11/2009 Worth
2009/0281951 A1 11/2009 Shakkarwar
2009/0287558 A1 11/2009 Seth et al.
2009/0298427 A1 12/2009 Wilkinson et al.
2009/0327121 A1 12/2009 Carroll et al.
2010/0005025 A1 1/2010 Kumar et al.
2010/0008535 A1 1/2010 Abulafia et al.
2010/0010906 A1 1/2010 Grecia
2010/0041368 A1 2/2010 Kumar
2010/0042471 A1 2/2010 Chang et al.
2010/0063906 A1 3/2010 Nelsen et al.
2010/0076833 A1 3/2010 Nelsen
2010/0082487 A1 4/2010 Nelsen
2010/0082490 A1 4/2010 Rosenblatt et al.
2010/0088188 A1 4/2010 Kumar et al.
2010/0097180 A1 4/2010 Cardullo
2010/0130172 A1 5/2010 Vendrow et al.
2010/0131415 A1 5/2010 Sartipi
2010/0174993 A1 7/2010 Pennington et al.
2010/0175287 A1 7/2010 Gupta et al.
2010/0185505 A1 7/2010 Sprogoe et al.
2010/0205063 A1 8/2010 Mersky
2010/0280921 A1 11/2010 Stone et al.
2010/0293536 A1 11/2010 Nikitin et al.
2010/0299194 A1 11/2010 Snyder et al.

(56) References Cited

U.S. PATENT DOCUMENTS

| | | | | |
|---|---|---|---|---|
| 2010/0299266 | A1 | 11/2010 | Catania et al. | |
| 2010/0304852 | A1 | 12/2010 | Szrek et al. | |
| 2011/0087592 | A1 | 4/2011 | Veen et al. | |
| 2011/0091092 | A1 | 4/2011 | Nepomniachtchi et al. | |
| 2011/0106698 | A1 | 5/2011 | Isaacson et al. | |
| 2011/0125607 | A1 | 5/2011 | Wilen | |
| 2011/0145044 | A1 | 6/2011 | Nelsen et al. | |
| 2011/0161226 | A1 | 6/2011 | Courtion et al. | |
| 2011/0173083 | A1 | 7/2011 | Reed et al. | |
| 2011/0202419 | A1 | 8/2011 | Mamdani et al. | |
| 2011/0234514 | A1 | 9/2011 | Gothard | |
| 2011/0246284 | A1 | 10/2011 | Chaikin et al. | |
| 2011/0251962 | A1 | 10/2011 | Hruska | |
| 2012/0004769 | A1 | 1/2012 | Hallenbeck et al. | |
| 2012/0099780 | A1 | 4/2012 | Smith et al. | |
| 2012/0136780 | A1 | 5/2012 | El-Awady et al. | |
| 2012/0203572 | A1 | 8/2012 | Christensen | |
| 2012/0209688 | A1 | 8/2012 | Lamothe et al. | |
| 2012/0234911 | A1 | 9/2012 | Yankovich et al. | |
| 2012/0271689 | A1 | 10/2012 | Etheredge et al. | |
| 2012/0284185 | A1 | 11/2012 | Mettler et al. | |
| 2013/0073388 | A1 | 3/2013 | Heath | |
| 2013/0290121 | A1 | 10/2013 | Simakov et al. | |
| 2013/0304561 | A1 | 11/2013 | Warner et al. | |
| 2014/0006268 | A1 | 1/2014 | Roberts et al. | |
| 2014/0019238 | A1 | 1/2014 | Blatchley et al. | |
| 2014/0138266 | A1* | 5/2014 | McCormick | F25D 3/06 206/205 |
| 2015/0278845 | A1 | 10/2015 | Sorem et al. | |
| 2015/0313251 | A1* | 11/2015 | Pascual | A23L 29/256 426/584 |
| 2016/0107796 | A1* | 4/2016 | Sibley | B65B 29/00 206/213.1 |
| 2016/0251133 | A1* | 9/2016 | Ferry | B65D 71/72 206/558 |
| 2017/0076293 | A1 | 3/2017 | Cage et al. | |
| 2017/0339991 | A1* | 11/2017 | Cantais | A23C 9/133 |

FOREIGN PATENT DOCUMENTS

| | | | |
|---|---|---|---|
| EP | 2128809 | A1 | 12/2009 |
| JP | 2002189963 | A | 7/2002 |
| JP | 2002318951 | A | 10/2002 |
| JP | 2003208541 | A | 7/2003 |
| KR | 20010106187 | A | 11/2001 |
| KR | 20040028487 | A | 4/2004 |
| KR | 20040052531 | A | 6/2004 |
| KR | 1020040052502 | A | 6/2004 |
| KR | 20040069294 | A | 8/2004 |
| KR | 20050118609 | A | 12/2005 |
| KR | 20090123444 | A | 12/2009 |
| WO | 2004012118 | A1 | 2/2004 |
| WO | 2005111882 | A1 | 11/2005 |
| WO | 2008005018 | A9 | 1/2010 |
| WO | 2013078499 | A1 | 6/2013 |

OTHER PUBLICATIONS

International Search Report of PCT/US 13/23945, dated Mar. 29, 2013; 2 pages.

ISA European Patent Office, Search Report of EP09812328.4, dated Jul. 4, 2012, Germany, 6 pages.

ISA Korea, International Search Report of PCT/US2009/056118, dated Apr. 19, 2010, 3 pages.

ISA Korea, International Search Report of PCT/US2009/058111, dated May 26, 2010, 3 pages.

ISA Korean Intellectual Property Office, International Search Report of PCT/US2010/060875, dated Jul. 29, 2011, 10 pages.

ISA United States Patent and Trademark Office, International Search Report of PCT/US2008/073910, dated Nov. 10, 2008.

Nelsen, David A., "Systems and Methods to Manage and Control Use of a Virtual Card," U.S. Appl. No. 13/158,349, filed Jun. 10, 2011, 62 pages.

* cited by examiner

VISCOUS LIQUID VESSEL FOR GIFTING

RELATED APPLICATIONS

This non-provisional patent application claims priority benefit, with regard to all common subject matter, of earlier-filed U.S. Provisional Patent Application No. 62/597,588, filed Dec. 12, 2017, and entitled "VISCOUS LIQUID VESSEL FOR TRANSACTION CARD." The identified earlier-filed provisional patent application is hereby incorporated by reference in its entirety into the present application.

BACKGROUND

1. Field

Embodiments of the invention relate to gift presentation. More specifically, embodiments of the invention relate to gifts disposed in a vessel filled with a substance from which the gift must be removed.

2. Related Art

Transaction cards (which may also be known as gift cards, stored value cards, and the like) are a common gift to give to others. Transaction cards make good gifts for both children and adults because interests change over time and the gift-giver may not know what gift would be desired by the gift recipient. However, the recipient may be unenthusiastic about receipt of a transaction card because the transaction card does not provide immediate satisfaction.

Further, a transaction card gift is typically sealed in an envelope with a typical letter such as a birthday card, holiday letter, or the like. This is a normal and somewhat expected gift receptacle that does not typically generate excitement. What is lacking in the prior art is a way to present a gift card in a way that will be new, fun, and exciting for the recipient.

SUMMARY

Embodiments of the invention solve these problems by providing a gift giving vessel containing a viscous liquid for securing a gift. The recipient will, upon receiving the gift giving vessel, extract the gift (such as the above-discussed transaction card) from the viscous liquid. Therefore, in addition to the delayed gratification of getting to later utilize the transaction card (or other gift), the recipient receives immediate satisfaction in the interaction with and extraction from the viscous liquid. This allows the gift-giver to present the transaction care in a way that is new, fun, and exciting. In some embodiments, the gift-giver will purchase the gift giving vessel and the transaction card separately, and place the transaction card into the gift giving vessel prior to providing the gift.

A first embodiment of the invention is directed to a viscous liquid vessel system for securing a gift, the viscous liquid vessel system comprising a vessel that presents a size and a shape that is configured to receive the gift, a viscous liquid disposed in the vessel, wherein the viscous liquid is configured to surround the gift within the vessel, and wherein the viscous liquid is configured to resist removal of the gift therefrom without damaging the gift upon removal.

A second embodiment is directed to a viscous liquid vessel system for securing a transaction card, the viscous liquid vessel system comprising a vessel that presents a size and a shape that is configured to receive the transaction card, a viscous liquid disposed in the vessel, wherein the viscous liquid is configured to surround the transaction card within the vessel, and wherein the viscous liquid is configured to resist removal of the transaction card therefrom without damaging the transaction card upon removal.

A third embodiment is directed to a viscous liquid vessel system for securing a transaction card, the viscous liquid vessel system comprising a vessel that presents a size and a shape that is configured to receive the transaction card, a viscous liquid disposed in the vessel, a decorative item suspended in the viscous liquid, wherein the viscous liquid is configured to surround the transaction card within the vessel, and wherein the viscous liquid is configured to resist removal of the transaction card therefrom without damaging the transaction card upon removal.

Additional embodiments may be directed to a method of giving a gift, a method of providing a gift giving vessel, a method of manufacturing a viscous liquid for a gift giving vessel, or other related methods to the disclosure herein.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWINGS

Embodiments of the invention are described in detail below with reference to the attached drawing figures, wherein.

Figure 1:
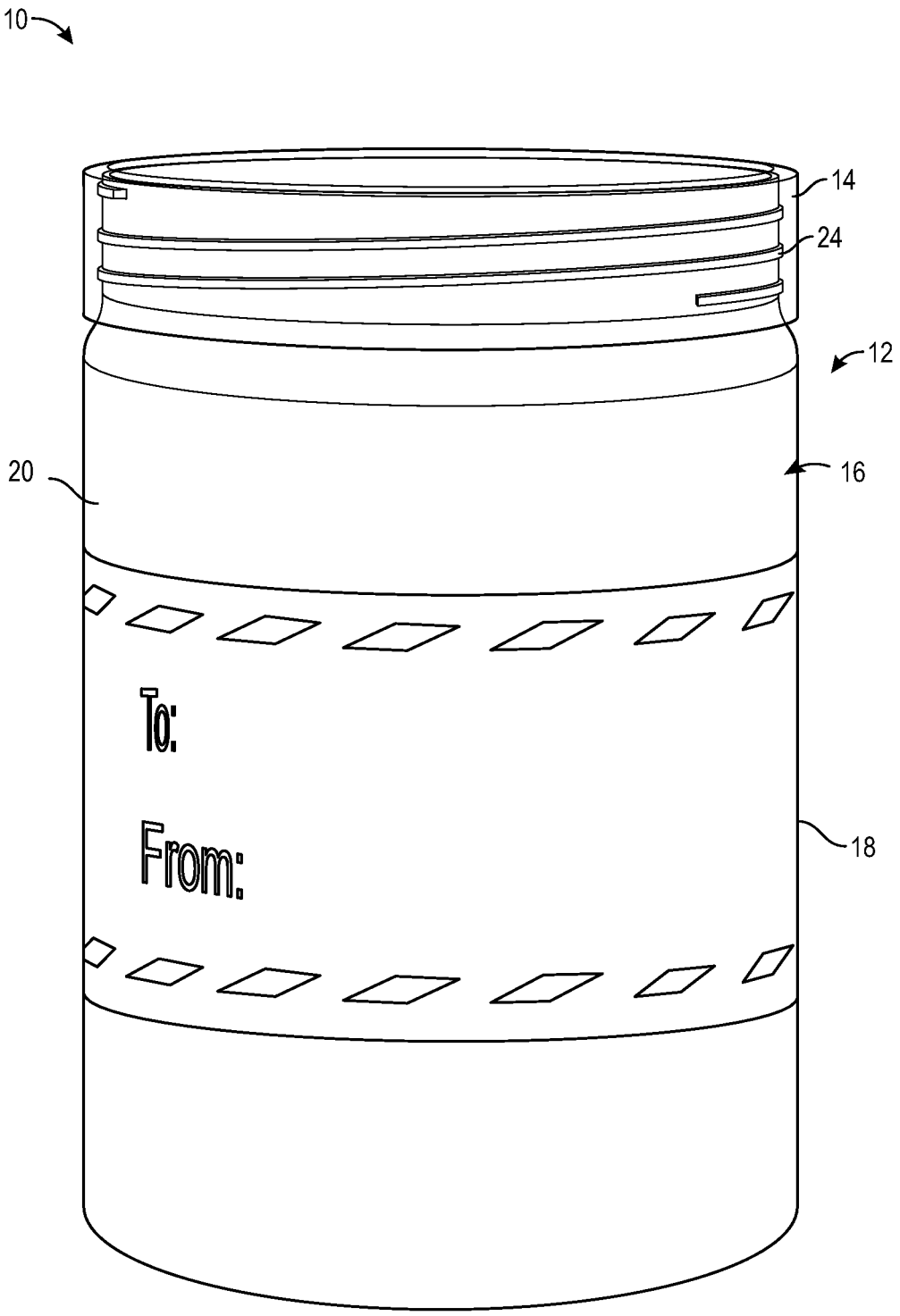
FIG. 1 is a front view of an embodiment of a viscous liquid vessel system.

The drawing figures do not limit the invention to the specific embodiments disclosed and described herein. The drawings are not necessarily to scale, emphasis instead being placed upon clearly illustrating the principles of the invention.

DETAILED DESCRIPTION

Embodiments of the invention solve the above-mentioned problems and provide a distinct advance in the art by providing a viscous liquid vessel system for securing a transaction card and giving as a gift. In embodiments, the viscous liquid vessel system comprises a vessel and a viscous liquid. The vessel presents a size and a shape that is configured to receive the transaction card. The viscous liquid is disposed in the vessel. The viscous liquid is configured to surround the transaction card within the vessel. The viscous liquid is also configured to resist removal of the transaction card therefrom without damaging the transaction card upon removal.

The following description of embodiments of the invention references the accompanying illustrations that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

The term "viscous liquid" is used herein as a general term for any of numerous substances. In some embodiments, the viscous liquid is a gelatinous substance. In some embodiments, the viscous liquid is a quasi-solid (which is also known as an amorphous solid, semi-solid, semi-liquid). "Quasi-solid" is a physical term a substance whose state lies between a solid and a liquid. While similar to solids in some respects, such as having the ability to support their own weight and hold their shapes, a quasi-solid also shares some properties of liquids, such as conforming in shape to something applying pressure to it and the ability to flow under pressure. Various other terms may also be used to describe the various embodiments of the viscous liquid, such as jellylike, glutinous, viscous, viscid, mucilaginous, sticky, gluey, gummy, slimy, gooey, gunky, or the like. The viscosity of the viscous liquid may be such that, in embodiments, a transaction card is easily and without damage inserted into the viscous liquid and subsequently removed therefrom. In some embodiments, the viscous liquid may be slightly more or less dense than other gel type products that may be found in the market presently. The viscous liquids described herein may have particular formulas specifically designed for the purposes of gift giving in such embodiments.

An exemplary embodiment of a viscous liquid vessel system 10 is presented in FIG. 1. In some embodiments, the viscous liquid vessel system 10 comprises a vessel 12 that may be transparent, translucent, smooth, textured, and may present labels and decals. Contents of the interior of the vessel 12 may be visible through the vessel 12 or the vessel 12 may be opaque blocking the view. The vessel 12 presents a size and a shape for receiving and securing a gift, in some embodiments the gift may be a transaction card.

The vessel 12, of some embodiments of the invention, presents a cylindrical shape. The vessel 12 may therefore be a jar shape, a can shape, or other cylindrical shape. The vessel 12 may comprise a lid 14 for enclosing contents 16. The vessel 12 presents a substantially single-open-ended cylinder. The vessel 12 may present a general front side and a general back side. The front side may include a label 18 configured with graphics or a short message to be completed by the purchaser.

The contents 16 of the vessel 12, in some embodiments, may comprise, for example, a viscous liquid 20 and a gift (not shown). The viscous liquid 20 may fill the vessel 12 and provide a medium for securing the gift inside. The viscous liquid 20 is disposed in the vessel (as can be seen through the transparent walls of this exemplary embodiment). The viscous liquid 20 is configured to surround the gift within the vessel 12. The viscous liquid 20 is also configured to resist removal of the gift therefrom without damaging the gift upon removal. The viscous liquid 20 may also provide an interesting texture and experience for the recipient in removing the gift.

In some embodiments, the viscous liquid 20 is enclosed in the vessel 12 with a lid 14. The lid 14 may be secured on the vessel 12 for enclosing the viscous liquid 20 and the gift. The lid 14 may screw on, snap on, or may be secured with an adhesive or may be part of the vessel 12. The lid 14 may be removed to access the contents 16 of the vessel 12 or the lid 14 may comprise a paper cover or other material and the recipient may punch a hole in the lid 14 to retrieve the enclosed gift.

In some embodiments, the vessel 12, or container, may comprise a label 18. The label 18 may be attached to the vessel 12 with an adhesive or be formed of the vessel 12, as in a molding or stamping process during manufacturing. For example, the label 18 may be paper and outline where a name of a recipient may be written (e.g. "To:") and the name of a gift-giver may be written (e.g. "From:"). The label 18 may have any sort of graphics such as hearts, fireworks, snow, trees or any other graphics that may represent seasons, holidays, personal celebrations, or any other such reason for giving a gift. In other embodiments, there may be no label, or the label may be unsecured from the vessel 12.

In some embodiments, the label 18 may be purchased with the graphics already printed on the label 18. In some embodiments, the label 18 may be purchased separately and applied to the vessel using an adhesive. In some embodiments, the label 18 may be purchased with printed graphics and in some embodiments the label 18 may be purchased such that the gift-giver may provide the graphics by printing, adding computer graphics, or simply writing or drawing on the label 18. The label 18 may thus include custom-printed information specific for the recipient. This may include a photograph of the recipient, a printed name or other information, a favorite character or design of the recipient, or other information.

In some embodiments, the label 18 may comprise any information about the recipient or the gift-giver such as name, address, telephone number, or any other information needed to send the viscous liquid vessel system 10 through a courier service. The label 18 may also comprise any postage necessary to send the viscous liquid vessel system 10 through said courier service.

In some embodiments, the label 18 may include a barcode. The barcode may be connected to an account associated with the gift if, for example, the gift is a transaction card contained in the viscous liquid vessel system 10. When the barcode is scanned the transaction card can be purchased and a monetary amount added to the transaction card. This way the transaction card can be purchased in the vessel 12 at a brick-and-mortar retailer. Once the viscous liquid vessel system 10, including the transaction card, has been purchased, the transaction card may be activated by the recipient upon retrieving the transaction card from the viscous liquid 20. This allows the user to give the vessel 12 as a gift without actually inserting the transaction card. This may also allow the user to customize the characteristics of the transaction card, such as an amount of the transaction card, a retailer associated with the transaction card, or other characteristics.

Figure 2:
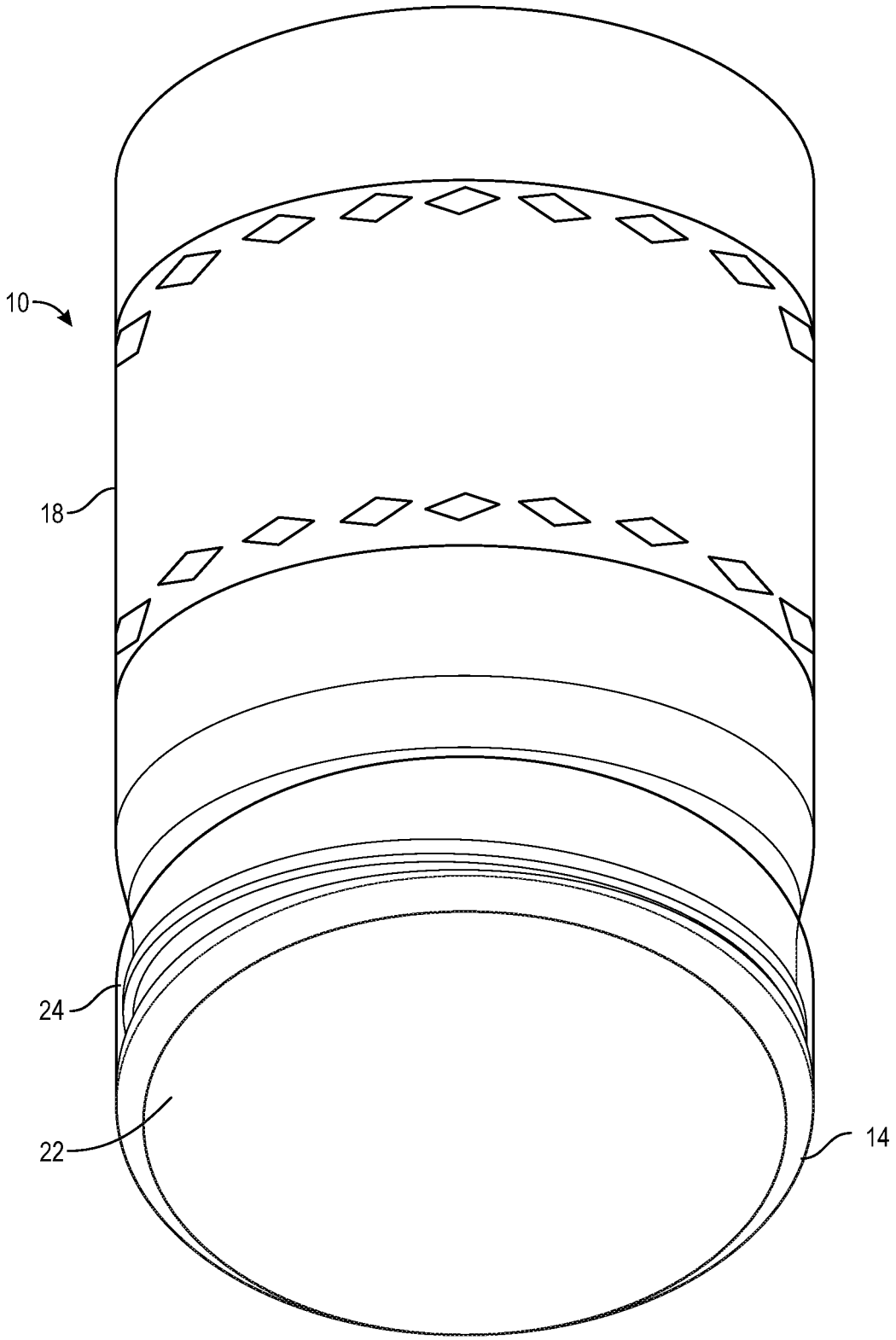
FIG. 2 is a top view of an embodiment of the viscous liquid vessel system.

An embodiment depicted in FIG. 2 presents a top view of the viscous liquid vessel system 10. The embodiment presents the lid 14 with a lid label 22 visible on the lid 14. As depicted, the lid 14 presents a single-open-ended cylinder, disk, or annular shape. The lid 14 is configured to be selectively secured to the vessel 12. The lid 14 may include a threaded segment 24 (also visible in FIG. 1) for securing the lid to a corresponding threaded segment of the vessel 12 upon a rotation of the lid 14 thereon.

In some embodiments, not illustrated, the lid 14 may be a snap-on-type lid. The lid 14 may comprise a ridge on an interior portion. The vessel 12 may have a corresponding ridge or plurality of ridges on an upper exterior portion of the vessel 12 for receiving the ridge on the lid 14. When the lid 14 is pressed onto the vessel 12 the ridges on the lid 14 bend to allow the lid 14 to be pressed onto the vessel 12 and the lid 14 ridges snap into place under the vessel 12 ridges securing the lid 14 to the vessel 12. The lid 14 may be made of a plastic or rubber material that allows the lid 14 the elasticity to attach in as a snap on assembly or a twist on assembly, while allowing the lid to be subsequently removed by the recipient.

In some embodiments, the lid 14 comprises the lid label 22. The lid label 22 may provide graphics and receive information from a person such as name, address, or a note for the recipient. Further, the lid label 22 may comprise postage or any information required to send through any courier service in the United States or Internationally. The lid label 22 may comprise any characteristics or embodiments of the label 18 as described above.

Figure 3:
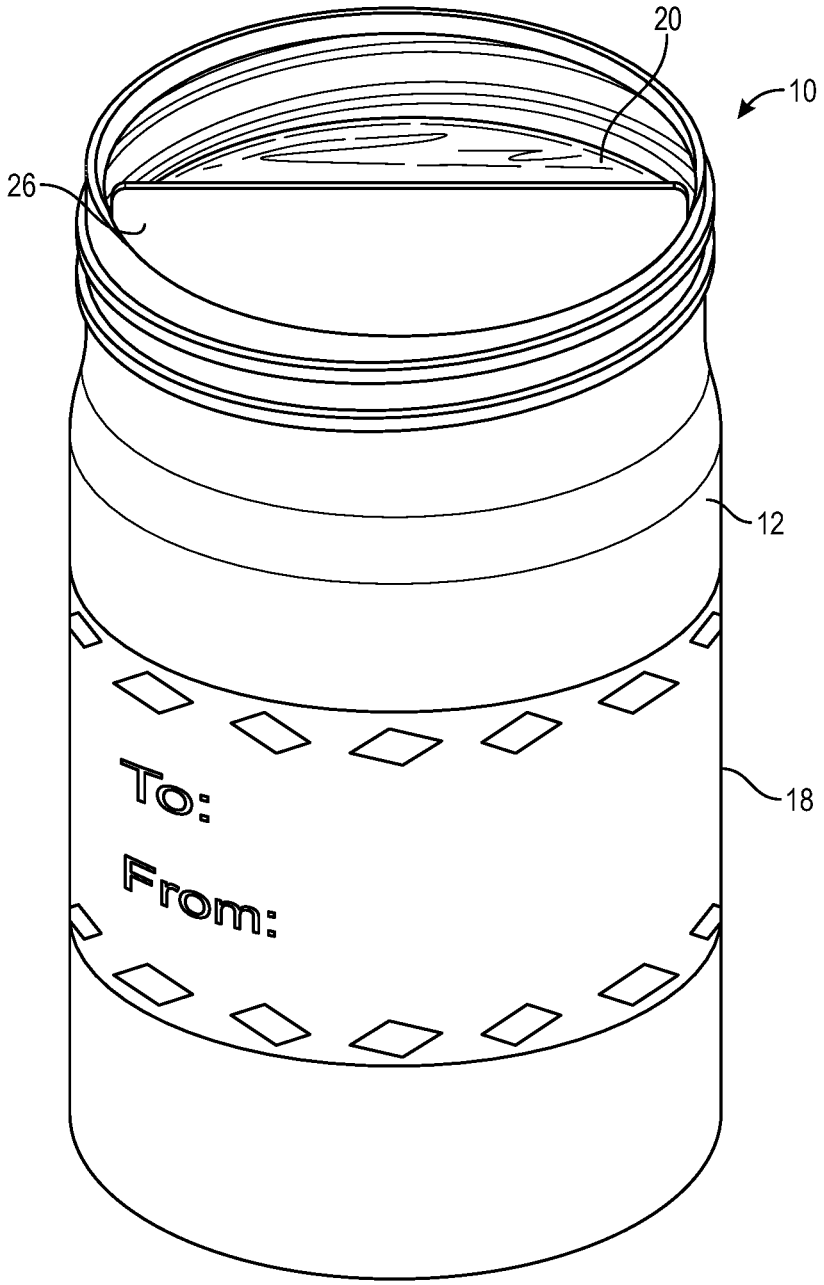
FIG. 3 is a perspective view of an exemplary embodiment of a viscous liquid vessel system with a lid removed.

FIG. 3 presents an embodiment of the viscous liquid vessel system 10 with the lid 14 removed and the gift, in this case a transaction card 26, visible through the opening. The transaction card 26 is disposed in the viscous liquid in the vessel 10. The transaction card 26 is surrounded directly by the viscous liquid 20. The viscous liquid 20 secures the transaction card in the vessel 12 resisting movement and preventing damage to the transaction card 26 if the vessel is dropped or sustains some sort of damage. In some embodiments, as shown, the transaction card 26 may slightly poke out of the viscous liquid 20. In some embodiments, the transaction card 26 is completely submerged in the viscous liquid 20 such that the transaction card 26 may not be visible to the recipient upon opening the vessel 12. Further, the recipient may have to reach into the viscous liquid 20 to retrieve the transaction card 26, or any sort of gift that may be submerged in the viscous liquid 20. This creates an exciting and new experience for the recipient of the transaction card 26, or any gift that may be submerged, than what is presently available.

In some embodiments of the invention, the viscous liquid vessel system 10 is sold without a transaction card 26 therein. In these embodiments, the purchaser purchases the transaction card 26 in addition to the viscous liquid vessel system 10 (either together or separately). The purchaser may then remove the lid 14 and insert the transaction card 26 into the viscous liquid 20 and the vessel 10. The purchaser may then return the lid 14 to the vessel 16. In other embodiments, the transaction card 26 may be sold as a component of the viscous liquid vessel system 10. In these embodiments, the transaction card 26 is sold together with the viscous liquid vessel system 10.

In some embodiments, as described above, the gift may be a transaction card 26. The vessel 12 may be a size and a shape configured to fit the transaction card 26 or may be deceptively large, or irregularly shaped, to conceal the possibility that the vessel 12 may hold the transaction card 26. For example, the vessel 12 may present any shape and size that is configured to receive the transaction card 26 therein, such as a pyramid, elliptical, square, triangular, or other shape that may provide a horizontal cross-section large enough to contain a transaction card 12 or the specific gift that is contained. These different shape and size options may create a fun and exciting method for receiving a gift that peaks a recipient's interest as well as creating wonder as to what may be inside the vessel 12.

In some embodiments, the gift may not be the transaction card 26 and may be any sort of object, toy, trinket, or any other object that may be given as a gift. The gift may be action figures, barn animals, toy cars and trucks, or any other small toys, trinkets, figurines, or any other small objects that may be given as gifts and compel a person to reach into the viscous liquid to retrieve said objects. Thus, embodiments of the invention may provide an even heightened sense of immediate satisfaction for a standard toy or gift.

Figure 4:
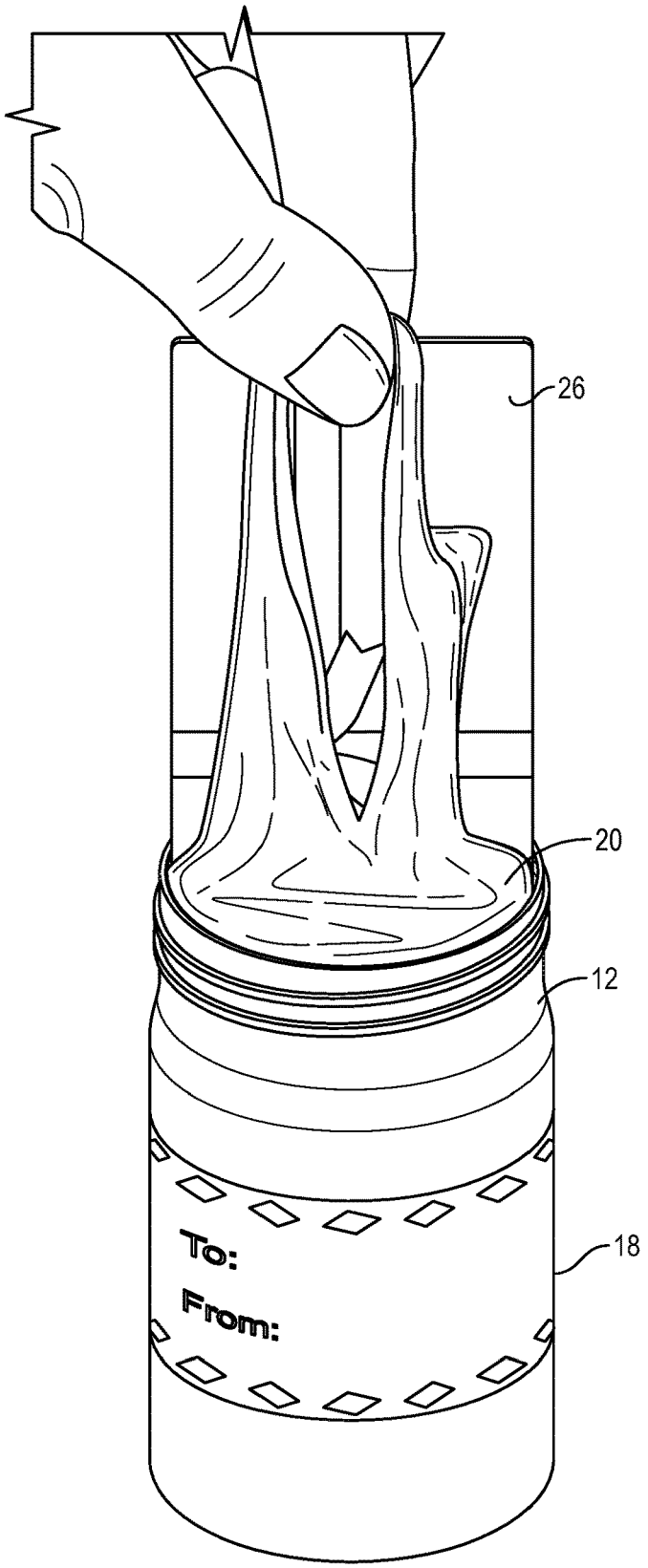
FIG. 4 is a perspective view of the exemplary embodiment of the viscous liquid vessel system with a transaction card being removed.

An embodiment, depicted in FIG. 4, shows the transaction card 12 being extracted from the viscous liquid 20 by the gift-giver, the recipient, or other person. The viscous liquid 20 retains the transaction card 26 within the vessel 12, so as to resist removal of the transaction card 26 therefrom. The viscous liquid at least partially adheres to the transaction card 26 when pulled from the vessel. Thus, as the person pulls the transaction card 26 from the viscous liquid 20, the viscous liquid 20 will resist allowing the transaction card 26 to be removed. This is a small amount of resistance that does not damage the transaction card 26. This may provide immediate satisfaction, fun, and excitement to the person. The resisting may be caused at least in part by a high surface tension of the viscous liquid 20, or other chemical properties.

A list of possible chemical properties for embodiments of the viscous liquid 20 is provided below. It should be noted that these are exemplary chemical compositions for various viscous liquids. Embodiments of the invention may include the following.

| Exaemple Ingredient List 1 | CAS# | % |
|---|---|---|
| Guar Gum (2-hydroxy-3-(trimethylammonio)propyl ether, chloride) | 65497-29-2 | 36.90 |
| Aseptic (methyl 4-hydroxybenzoate) | 99-76-3 | 1.00 |
| Water (distilled, conductivity or of similar purity) | 7732-18-5 | 61.75 |
| Purple Pigment | 1325-82-2 | 0.15 |
| Blue Pigment | 1325-87-7 | 0.10 |
| Green Pigment | 14302-13-7 | 0.10 |

| Example Ingredient List 2 | CAS# | % |
|---|---|---|
| Guar Gum (2-hydroxy-3-(trimethylammonio)propyl ether, chloride) | 65497-29-2 | 36.90 |
| Aseptic (methyl 4-hydroxybenzoate) | 99-76-3 | 1.00 |
| Water (distilled, conductivity or of similar purity) | 7732-18-5 | 61.75 |
| White Pigment | 1314-23-4 | 0.10 |
| Green Pigment | 1328-53-6 | 0.10 |

| Example Ingredient List 3 | CAS# | % |
|---|---|---|
| Guar Gum (2-hydroxy-3-(trimethylammonio)propyl ether, chloride) | 65497-29-2 | 36.90 |
| Aseptic (methyl 4-hydroxybenzoate) | 99-76-3 | 1.00 |
| Water (distilled, conductivity or of similar purity) | 7732-18-5 | 62.00 |
| Green Pigment | 1328-53-6 | 0.10 |

The ingredient lists provided above are possible embodiments of the viscous liquid 20. Any pigments may be used and the chemical makeup may be altered to provide the necessary material properties described herein. In some embodiments, the Guar Gum may be provided in a range of 35-39%, 30-40%, 25-45%, or other range. In some embodiments, the Aseptic may be provided in a range of 0.5-1.5%, less than 2%, or less than 5%. In some embodiments, the Aseptic may not be used. In some embodiments, the water may be provided in a range at any percentage necessary based on the amount and number of pigments added to produce a desired color. For example, the water may be in the range of 59-64%, 55-65%, 50-70%, or other range. The amount and number of pigments is dependent on the desired color and any variations in the ingredients may be made to achieve a desired material characteristic or property as described herein. In embodiments of the invention, the amount of pigment provided is less than 0.2% per pigment, less than 1% per pigment, or other range.

The chemical ingredients provided in the tables above give the useful material properties and characteristics to the viscous liquid 20. The material properties provide a liquid that resists movement of the transaction card 26 in and out of the viscous liquid 20 but does not damage the transaction card 26 either chemically or mechanically. For example, if the viscous liquid 20 is too dense the transaction card 26 may bend or break while being inserted into the viscous liquid 20. In this situation, the viscous liquid 20 may be too viscous to allow the viscous liquid 20 to move under pressure to allow the transaction card 26 to be inserted. Alternatively, if the viscous liquid 20 is not dense enough, the viscous liquid 20 may not hold the card securely in the vessel 12.

Further, the viscous liquid 20 may have a color that provides the recipient a glimpse that there is something inside but not reveal what the object is. In some embodiments, the viscous liquid 20 may be completely opaque, translucent, or transparent. The viscous liquid 20 may be any color such as, for example, blue, green, yellow, red, a mixture of colors, multiple layered colors like a rainbow, or different colors swirled around as in a whirlpool effect. This heightens the anticipation for the reveal of what is submerged in the viscous liquid 20.

In some embodiments, the viscous liquid 20 may also comprise festive items. For example, glitter, snowflakes, worms, rubber fingers and toes, rocket ships, plastic animals, super heroes, fairy dust, or any other item that may generate emotions upon sensing the items in the viscous liquid 20. In some embodiments, the festive items may be two coal eyes, a carrot nose, a corncob pipe, and a button nose representing a melted snowman that may be suspended in the viscous liquid 20.

In some embodiments, the viscous liquid 20 is made in the vessel 12 from a powder paste or other substance. For example, the viscous liquid 20 may be a dry formula that turns into the viscous liquid 20 when water is added. The viscous liquid vessel system 10 may be purchased with a gift in it or a gift added then the purchaser or anyone else may add water or some other liquid to the vessel 12 containing the dry formula and the mixture turns into the viscous liquid 20. In some embodiments, the dry formula may be powder turning into white snow when the water is added.

Figure 5:
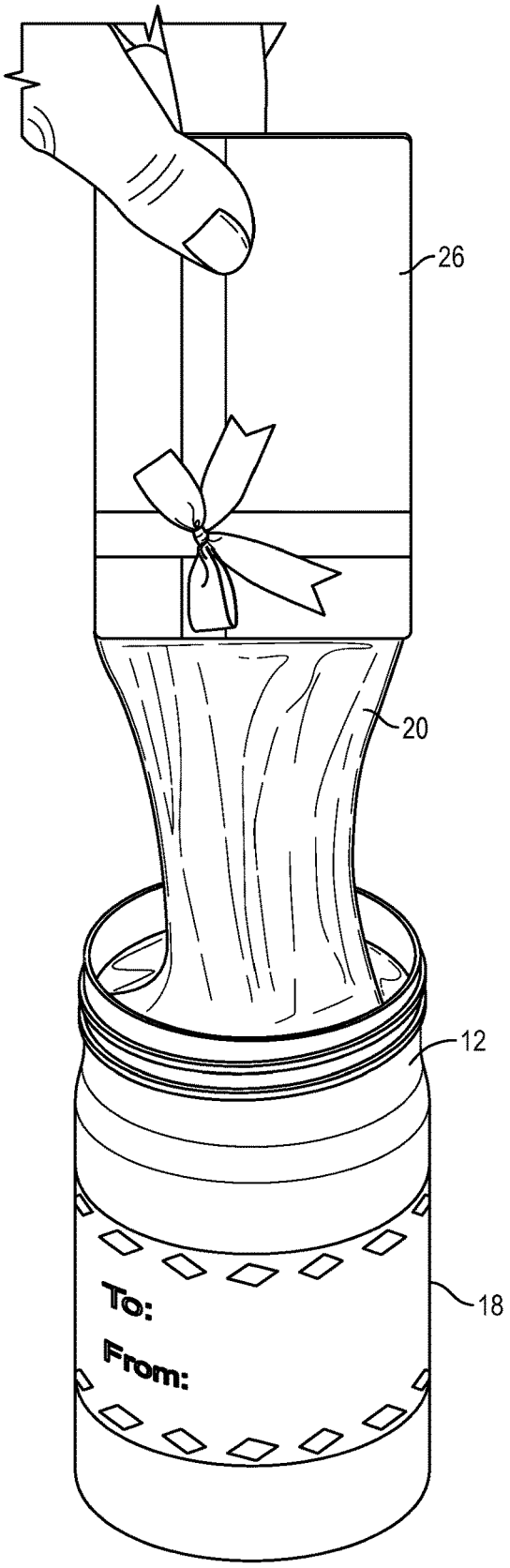
FIG. 5 is a perspective view of the exemplary embodiment of the vessel with a transaction card being removed and the viscous liquid adhering to the transaction card.

An embodiment, depicted in FIG. 5, shows the transaction card 26 removed from the vessel 12 with the viscous liquid 20 adhering to the card and stretching from the interior of the vessel 12 to the transaction card 26. As can be seen, the viscous liquid 20 continues to adhere to the transaction card 26 both on and below the transaction card 26. This continued adherence provides the above-discussed immediate satisfaction for the user, as this allows for the user to remove the card while providing enjoyment at the view of the expanding viscous liquid 20.

In embodiments of the invention, the viscous liquid 20 is configured to not harm or otherwise damage the transaction card 26. As such, the transaction card 26 may be added to the viscous liquid 20 and removed from the viscous liquid 20 without any damage being caused to the transaction card 26. For example, this may include not removing typed information, not removing a scratch-off foil, not removing an acrylic resin, not interfering with a magnetic strip, and otherwise leaving the transaction card 26 unchanged. As such, the viscous liquid 20 is configured to stretch but not permanently adhere to the transaction card 26.

Figure 6:
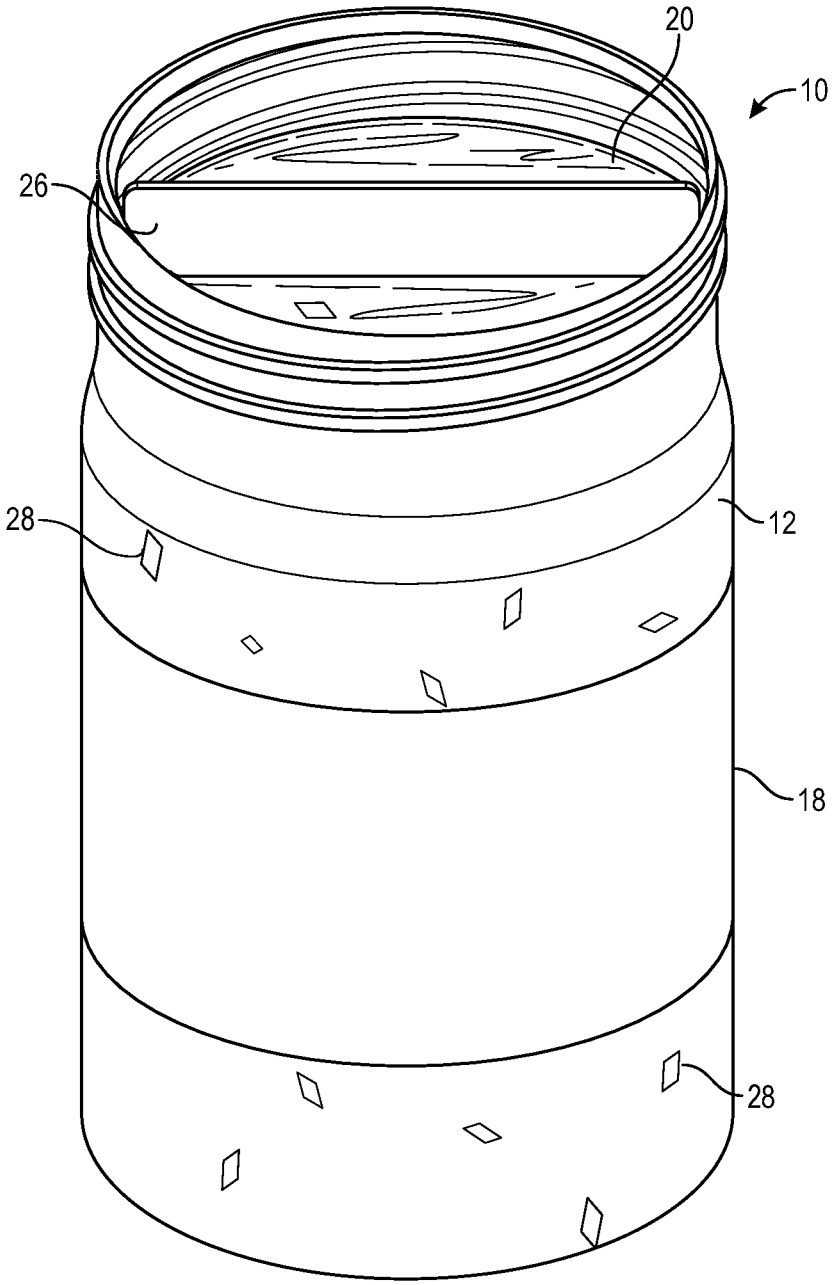
FIG. 6 is a perspective view showing an exemplary embodiment of the viscous liquid vessel system with additive items in the viscous liquid.

FIG. 6. depicts another exemplary embodiment of the viscous liquid vessel systems 10. It should be appreciated that various embodiments may come in any number of sizes, shapes, colors, consistencies, and have other properties. For example, the vessel 12 may present any shape and size that is configured to receive a transaction card 26 therein, such as a pyramid, elliptical, square, triangular, or other shape that may provide a horizontal cross-section large enough to contain a transaction card 26 or the specific gift that is contained. In some embodiments, the shape is irregular such as a JELLO mold, a football, a baseball bat, Christmas tree, a snowman or any other irregular shape that may be used to symbolize a holiday or event.

In some embodiments, the vessel 12 may be non-rigid. In these embodiments, the viscous liquid may fill the non-rigid vessel 12 and expand the non-rigid vessel 12 to a certain shape.

The viscous liquid vessel system 10 may be given as a gift for birthdays, holidays, or just as a fun vessel 12 in which to provide a gift. The packaging, such as the vessel 12, and the labels on the exterior of the vessel 12, may be different shapes and colors with different graphics to provide unique experiences related to the theme of the gift. For example, a birthday gift for a child that likes space may be provided with a space-themed vessel 12 having a viscous liquid 20 configured to look like space with glitter for stars and different colors may be swirled in the viscous liquid 20 to simulate galaxies and nebulae. Other example themes could be unicorns or other characters, 'melted snowman' or other themes. Any graphics may be added to a label 18 for any general vessel 12 for any general viscous liquid vessel system 10 representing the theme of the contents 16 and the viscous liquid 20. Further, the label 18 may provide a name, address, a short message, or any other information that the gift-giver would like to relay to the recipient.

In some embodiments, as shown in FIG. 6, a set of additive items 28 (which may also be referred to as decorative items or festive items) may be disposed in the viscous liquid 20. In some embodiments may be interactive or toys themselves. The decorative items may, as an example, be coal (for naughty children) or gold (for nice children) or some other items symbolizing character or personality. In some embodiments, the festive item may be dice, a coin, or a small puzzle or game. For example, the dice may have "yes" on one side and "no" on another side and the recipient may ask a question and roll the dice or flip the coin for to determine the answer. Further, the dice may provide an illusion of telling the future with sayings such as "ask again," "outlook looks good," or "outlook looks bad." These are exemplary additive items 28 that may be included in the viscous liquid vessel system 10, and it should be appreciated that other additive items 28 may also be provided in the viscous liquid 20 or added by the gift-giver prior to giving the gift.

In some embodiments, the viscous liquid 20 is combined with other objects and/or materials to create different forms of the viscous liquid 20. For example, the viscous liquid may be combined with plastic or rubber beads or balls to create a new and exciting texture. In some embodiments, the additive items 28 may appear to be dangerous. The plastic or rubber additive items 28 may present an appearance of glass or other sharp objects to comically dissuade the recipient from pushing their hand into the viscous liquid. However, upon retrieving the gift, the recipient discovers that what appears to be sharp objects is just soft rubber or plastic. In some embodiments, the additive items 28 may appear to be gross or scary. For example, the additive items 28 may be rubber or plastic worms or fish eyes. The additive items 28 may be in the viscous fluid 20 and in some embodiments the additive items 28 may contain viscous fluid 20 inside and have soft shells that may cause the items to squish and, in some embodiments, the additive items 28 may even pop releasing the viscous liquid 20 from inside. In some embodiments, the viscous liquid inside the objects may be water or any liquid other than the viscous liquid 20.

In some embodiments, the viscous liquid vessel system 10 is purchased separately from the gift and the gift may be added to the viscous liquid vessel system 10 by the gift-giver. The viscous liquid vessel system 10 may be purchased at a brick-and-mortar retailer with, for example, a transaction card 26 and the transaction card 26 may be inserted into the vessel 12 and the viscous liquid 20 by the purchaser. The purchaser may then give the viscous liquid vessel system 10 including the transaction card 26 to the user personally or send through any courier service. Further, the viscous liquid vessel system 10 may be purchased with the transaction card 26 inside. The label 18 on the exterior of the vessel 12 may have a barcode linked to the account associated with the transaction card 26 and a monetary amount may be added to the account upon purchase of the viscous liquid vessel system 10 as described above.

In some embodiments, the viscous liquid vessel system 10 is purchased online with or separately from the gift. When the gift is purchased with the viscous liquid vessel system 10 the gift may be inserted into the vessel 12 and viscous liquid 20 by the manufacturer, by a third-party distributor, or by the online retailer. The viscous liquid vessel system 10 may be sent directly to the gift recipient with an included card or an attached label 18 as described above. When the gift is purchased separately from the viscous liquid vessel system 10 the gift and the viscous liquid vessel system 10 may be sent directly to the purchaser and they may assembly the gift to be sent in the viscous liquid 20 vessel system.

Embodiments of the invention are directed to a method of providing a gift. While the various steps performed by the gift giver are discussed throughout, an exemplary embodiment performed by the gift-giver will now be discussed for clarity. The method comprises the steps of receiving the viscous liquid vessel system 10, receiving the transaction card 26, removing the cap 14, inserting the transaction card 26 into the viscous liquid 20 within the vessel 12, reapplying the cap 14, and giving the liquid vessel system 10 as a gift.

Although the invention has been described with reference to the embodiments illustrated in the attached drawing figures, it is noted that equivalents may be employed and substitutions made herein without departing from the scope of the invention.

The invention claimed is:

1. A viscous liquid vessel system for securing a transaction card, the viscous liquid vessel system comprising:

a vessel that presents a size and a shape that is configured to receive the transaction card, the vessel comprising a label attached to the exterior of the vessel, the label on the vessel comprising a bar code configured to activate the transaction card;

a viscous liquid disposed in the vessel, wherein the viscous liquid is configured to surround the transaction card within the vessel, wherein the viscous liquid is configured to resist removal of the transaction card therefrom without damaging the transaction card upon removal.

2. The viscous liquid vessel system of claim 1, wherein the label presents at least one graphic and is configured to receive input from a gift-giver.

3. The viscous liquid vessel system of claim 1, wherein the viscous liquid is configured to conceal the transaction card from an exterior of the vessel while the transaction card is disposed within the viscous liquid.

4. The viscous liquid vessel system of claim 3, wherein the vessel is transparent.

5. The viscous liquid vessel system of claim 1, wherein the viscous liquid is enhanced with at least one decorative item suspended in the viscous liquid.

6. The viscous liquid vessel system of claim 1, wherein the viscous liquid comprises guar gum, aseptic, and water.

7. The viscous liquid vessel system of claim 6, wherein the viscous liquid comprises at least one coloring pigment.

8. The viscous liquid vessel system of claim 7, wherein a percentage amount of guar gum is provided in a range of 35-39% of the viscous liquid, a percentage amount of the aseptic is provided in a range of 0.5-1.5% of the viscous liquid, and a remaining percentage amount of water.

9. A transaction card gift assembly, comprising:

a viscous liquid vessel that presents a size and a shape configured to receive a transaction card;

a lid secured to the vessel;

a viscous liquid disposed in the vessel, the transaction card in the vessel and surrounded by the viscous liquid;

wherein the viscous liquid is configured to resist removal of the transaction card therefrom without damaging the transaction card upon removal.

10. The transaction card gift assembly of claim 9, wherein the viscous liquid vessel system is configured to be ordered by a gift-giver concurrently with the transaction card.

11. The transaction card gift assembly of claim 9, wherein the transaction card is purchased separately and inserted by a gift-giver prior to giving the viscous liquid vessel system as a gift.

12. The transaction card gift assembly of claim 9, further comprising an additive item disposed in the viscous liquid.

13. The transaction card gift assembly of claim 12, wherein the additive item is at least one from a group of plastic or rubber worms, balls, and beads.

14. The transaction card gift assembly of claim 9, further comprising:

a decorative item suspended in the viscous liquid.

15. The transaction card gift assembly of claim 14, wherein the transaction card is not visible from an exterior of the vessel, and wherein the decorative item is visible from the exterior of the vessel.

16. The transaction card gift assembly of claim 9, wherein the viscous liquid is configured to at least partially conceal the transaction card from an exterior of the vessel.

17. The transaction card gift assembly of claim 14, wherein the decorative item is at least one from the group comprising glitter, snow decals, sports items, or snowman parts.

18. The transaction card gift assembly of claim 9, further comprising a label attached to the vessel, wherein the label comprises a barcode associated with an account, and wherein the account is further associated with the transaction card.

19. The transaction card gift assembly of claim 9, wherein the viscous liquid comprises guar gum, aseptic, and water.

* * * * *